United States Patent [19]

Bocquet et al.

[11] Patent Number: 4,583,971

[45] Date of Patent: Apr. 22, 1986

[54] CLOSED DRUG DELIVERY SYSTEM

[75] Inventors: Jacques R. Bocquet, Brussels; Richard P. Goldhaber, Waterloo; Jean Kersten, Villers St. Amand; Jean-Marie Mathias, Nivelles, all of Belgium; Stephen Pearson, Ingleside, Ill.

[73] Assignee: Travenol European Research and Development Centre (TERADEC), Nivelles, Belgium

[21] Appl. No.: 578,908

[22] Filed: Feb. 10, 1984

[51] Int. Cl.[4] ..... A61J 1/00

[52] U.S. Cl. ..... 604/82; 604/88; 604/414

[58] Field of Search ..... 604/88, 89, 91, 87, 604/82, 414, 416, 403, 56; 206/219, 222; 141/329, 330

[56] References Cited

U.S. PATENT DOCUMENTS

| | | | |
|---|---|---|---|
| 2,362,025 | 11/1944 | Price . | |
| 4,157,723 | 6/1979 | Granzow et al. | 141/1 |
| 4,265,280 | 5/1981 | Ammann et al. | 141/98 |
| 4,325,417 | 4/1982 | Boggs et al. | 141/98 |
| 4,340,049 | 7/1982 | Munsch | 604/29 |
| 4,381,776 | 5/1983 | Latham, Jr. | 604/56 X |
| 4,410,321 | 10/1983 | Pearson et al. | 604/56 |
| 4,411,662 | 10/1983 | Pearson | 604/411 |

FOREIGN PATENT DOCUMENTS

| | | |
|---|---|---|
| 0069686 | 1/1983 | European Pat. Off. . |
| 0117489 | 9/1984 | European Pat. Off. . |
| 0126642 | 11/1984 | European Pat. Off. . |
| 1453591 | 10/1976 | United Kingdom . |
| 2096464 | 3/1982 | United Kingdom . |

*Primary Examiner*—Stephen C. Pellegrino

*Attorney, Agent, or Firm*—John P. Kirby, Jr.; Bradford R. L. Price; George H. Gerstman

[57] ABSTRACT

A sterile, closed drug delivery system (10) is provided comprising a flexible container (12), a capsule (22) coupled to the flexible container and a standard glass drug vial (36) positioned within the capsule. The flexible container has a liquid diluent therein. The capsule has supporting legs (32–35) which extend inwardly from the capsule to support the vial and also a highly flexible, pleated cap (28) which enables the drug vial to be manually moved relative to the supporting legs. The capsule is coupled to the flexible container by means of a hollow spike (54) located within the capsule and a frangible member (58) located within the flexible container, which frangible member allows fluid passage only when it is broken. Manual pressing of the pleated cap moves the drug vial downwardly onto the spike, piercing the stopper of the drug vial. Once the frangible member is broken, there is sterile communication between the drug vial and the liquid diluent contents of the flexible container.

38 Claims, 4 Drawing Figures

CLOSED DRUG DELIVERY SYSTEM

TECHNICAL FIELD

The present invention concerns a novel closed drug delivery system enabling a safe and easy reconstitution of a drug just prior to use.

BACKGROUND ART

Many drugs are mixed with a diluent before being delivered intravenously to a patient. The diluent may be, for example, a dextrose solution, a saline solution or even water. Many such drugs are supplied in powder form and packaged in glass vials. Other drugs, such as some used in chemotherapy, are packaged in glass vials in a liquid state.

Powdered drugs may be reconstituted in a well-known manner, utilizing a syringe which is used to inject liquid into the vial for mixing, the syringe eventually withdrawing the mixed solution from the vial. When a drug must be diluted before delivery to a patient, the drug is often injected into a container of diluent, where the container may be connected to an administration set for delivery to a patient. More specifically, the diluent is often packaged in glass bottles, or flexible plastic containers such as are sold under the names MINI-BAG TM and VIAFLEX ® by Travenol Laboratories, Inc. of Deerfield, Ill. These containers have administration ports for connection to an administration set which delivers the container contents from the container to the patient. The drug is typically added to the container through an injection site on the container.

Drugs may be packaged separately from the diluent for various reasons. One of the most important reasons is that some drugs do not retain their efficacy when mixed with a diluent and thus cannot be stored for any substantial period of time. In some instances the drug and diluent will not stay mixed for a significant length of time. Also, drugs are often packaged separately from the diluent because many firms which manufacture drugs are not engaged in the business of providing medical fluids in containers for intravenous delivery.

Therefore, a doctor, nurse, pharmacist or other medical personnel must mix the drug and diluent. This presents a number of problems. The reconstitution procedure is time consuming. The operator must provide the proper diluent and a syringe before beginning. Often the powdered drug is "caked" at the bottom of the vial. Thus, when liquid is injected into the vial from a syringe, the surface area of contact between the liquid and the powdered drug may be quite small initially, thus making the mixing procedure even more time consuming. Because of the limited vial volume, the increasing drug concentration in the diluent makes it harder to finish the reconstitution process. The operator may attempt to solve this by repeatedly injecting solution into the vial, mixing and withdrawing the solution but this makes necessary additional injections and movement of the syringe which increase the likelihood of contamination. Also, it is sometimes difficult to get all of the drug and/or liquid out of the vial, thus increasing the time required to perform the reconstitution procedure.

The reconstitution procedure should be performed under preferably sterile conditions. In addition to such a requirement making the operator justifiably more cautious and consuming more time, sterile conditions are often hard to maintain. In some instances, a laminar flow hood may be required under which the reconstitution procedure is performed.

Some drugs such as, for example, some chemotherapy drugs, are toxic. Exposure of the operator to the drugs during reconstitution may be dangerous, especially if the operator works with such drugs on a daily basis and is repeatedly exposed to them.

A further problem is that the reconstitution provides a source of confusion as to which container contains which drug, because the diluent container must be marked with the drug with which it has been injected or at least the name of the patient to whom it should be delivered.

It can be seen that a closed system for separate storage of a drug and diluent would be most beneficial. Certain facts have until recently prohibited such a closed system on a commercially feasible, reasonably inexpensive basis, however. One factor which has made difficult the manufacture of a closed system having separate, selectively communicating compartments for a drug and a diluent has been the sterilization procedure. As an example, in the case of diluent in a flexible plastic container, the container with the diluent therein is sterilized by steam sterilization, or autoclaving. However, the heat generated during such a sterilization procedure would destroy the efficacy of many drugs. On the other hand, other sterilization means such as the use of ethylene oxide gas may not harm the drug but may harm the diluent. A system for sterilizing a drug and diluent separately and combining the two components into a single container having separate compartments for separate storage after sterilization is shown in a U.S. patent application in the name of William Schnell, entitled "Sterilized Liquid Mixing System," U.S. patent application Ser. No. 365,940, filed Apr. 6, 1982 and assigned to the assignee of the present invention.

These considerations mandate that, absent means to protect the drug and diluent during different sterilication steps, the system be formed by combining separate drug and diluent receptacles after they have been separately sterilized. This requires the manufacture of a sterile or at least an aseptic connection between the two receptacles. Sterile connectors are known, such as shown, for example, in U.S. Pat. Nos. 4,157,723, 4,265,280 and 4,325,417, all assigned to the assignee of the present invention. The connectors disclosed therein provide highly reliable, sterile connections. They do, however, employ a separate radiant energy source to make the connection and therefore a power supply to operate the energy source.

Another requirement of such a closed system is that it should prevent water vapor transmission from the receptacle holding the diluent to the receptacle holding the powdered drug. As discussed earlier, the storage of some powdered drugs with even a small amount of liquid destroys drug efficacy. Such a closed system should also be constructed in a manner which will facilitate easy and thorough mixing of the drug and the diluent.

In U.S. Pat. Nos. 4,410,321 and 4,411,662, both assigned to the assignee of the present invention, a closed drug delivery system is disclosed, in which a drug and a diluent are separatedly stored and selectively mixed under sterile conditions. In the illustrative embodiments, a sterile coupling is utilized which includes a permanently affixed molded junction. In some instances, however, it may be desirable to avoid the use of a permanently affixed molded junction, as part of the sterile coupling. To this end, we have developed a closed drug delivery system that enjoys most of the benefits of the system disclosed in U.S Pat. Nos. 4,410,321 and 4,411,662, yet avoids the use of a permanently affixed molded junction, allows safe and easy reconstitution of a drug just prior to use, and is relatively simple in construction and easy to manufacture.

DISCLOSURE OF THE INVENTION

In accordance with the present invention, a closed drug delivery system is provided which comprises a flexible container, a capsule coupled to the flexible container and a drug vial. The flexible container has a liquid diluent therein and a delivery outlet. The capsule that is coupled to the flexible container has means for supporting the drug vial and has flexible means for enabling movement of the drug vial relative to the supporting means. The drug vial has a drug therein, adapted to be mixed with the diluent. The drug vial is supported by the supporting means and is adapted for engagement by the flexible means. Means couple the capsule to the interior of the flexible container, with the coupling means including means for communicating with the interior of the drug vial. The communicating means is out of communication with the interior of the vial when the vial is in a first position supported by the supporting means. The communicating means is in communication with the interior of the vial when the vial has been moved relative to the supporting means and the vial is in another position within the capsule.

In the illustrative embodiment, the capsule has a relatively rigid bottom and side walls and the flexible means comprises a flexible member that is sealed at the top of the side walls. The flexible member is substantially deformable to enable manual downward movement thereof. The flexible member includes a plurality of pleats surrounding a planar central portion, with the flexible member being sealed to the side walls adjacent the periphery of the flexible member. The flexible member has a generally circular outline and the capsule carries means for enabling hanging of the capsule.

In the illustrative embodiment, the drug vial comprises a standard glass drug vial bottle having a pierceable stopper retained by a metal band. The communicating means comprises a spike for piercing the stopper when the vial is moved onto the spike.

In the illustrative embodiment, the supporting means comprise a plurality of legs extending inwardly from the capsule. In one embodiment, the legs extend upwardly from the bottom of the capsule while in another embodiment the legs extend radially inwardly from the side walls of the capsule.

In the illustrative embodiment, the coupling means include a frangible member preventing fluid flow unless the frangible member is broken.

A more detailed explanation of the invention is provided in the following description and claims, and is illustrated in the accompanying drawings.

DETAILED DESCRIPTION OF THE ILLUSTRATIVE EMBODIMENTS

Figure 1:
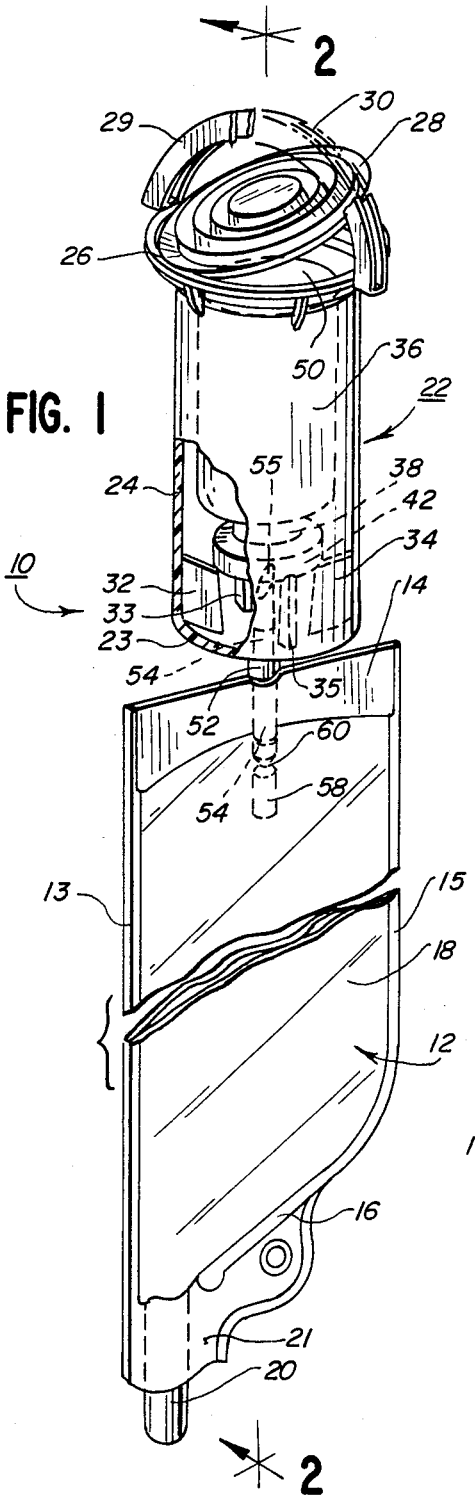
FIG. 1 is a perspective view, partially broken for clarity and also showing an opened capsule for clarity, of a closed drug delivery system constructed in accordance with the principles of the present invention.
Figure 2:
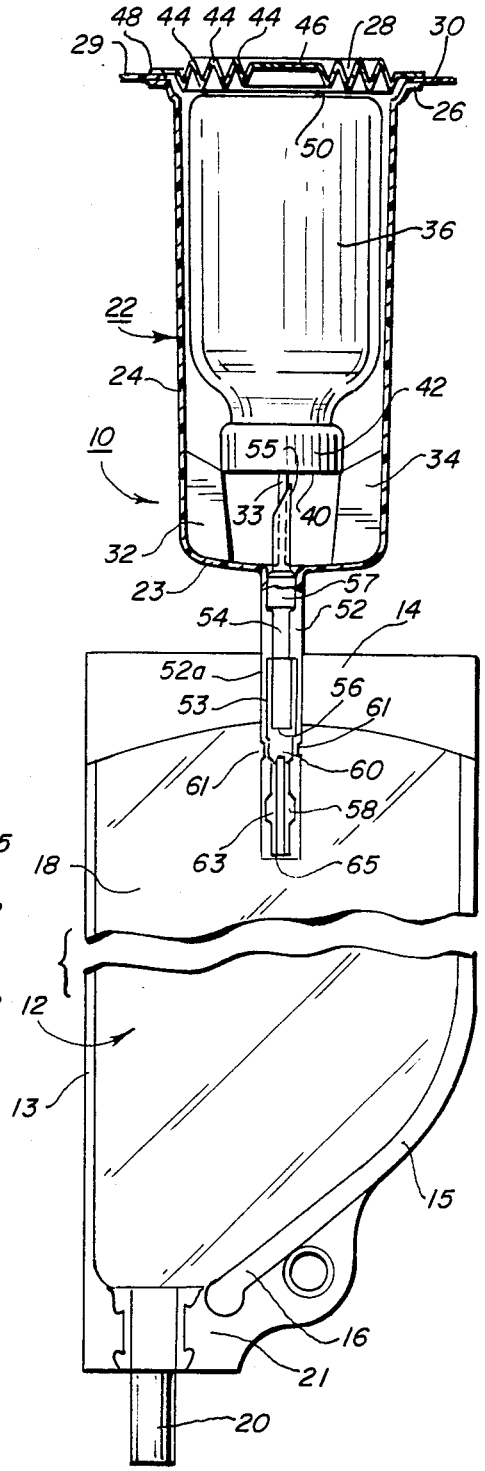
FIG. 2 is a cross-sectional elevation, taken along the plane of the line 2—2 of FIG. 1, but showing the top of the capsule in its normal, sealed position.

Referring to FIGS. 1 and 2, a drug delivery system 10 is shown therein. System 10 includes flexible container 12, preferably formed from flexible plastic (e.g., polyvinyl chloride) sheets having peripheral seals 13, 14, 15 and 16 to define a compressible chamber 18. Chamber 18 has a liquid diluent, such as a dextrose solution, a saline solution, or water therein. A delivery outlet port 20 communicates with chamber 18 and extends from flexible container 12 at the lowest location thereof. A portion of port 20 is sealed to the container by sealing the lower ends 21 of the plastic sheets against each other and around port 20.

A plastic capsule 22 is coupled to flexible container 12. Capsule 22 has a generally cylindrical configuration, with a bottom 23, side walls 24, and upper rim 26, a pleated top cap 28, and a pair of generally D-shaped hanger members 29, 30. The capsule bottom 23, side walls 24 which are formed in a generally circular configuration, rim 26 and hanger members 29, 30 are formed in a one-piece molded construction, while pleated cap 28 is formed separately and is subsequently bonded to rim 26. While cap 28 is illustrated in FIG. 1 as being unattached to rim 26, in use the cap 28 has been bonded to rim 26 and the drug delivery system is a closed, sterile system as will be discussed below.

The bottom 23 and side walls 24 of capsule 22 are relatively rigid, and supporting means in the form of four legs 32, 33, 34 and 35 extend inwardly from side walls 24 of the capsule at the bottom thereof. Legs 32–35 support a standard glass drug vial bottle 36 which is located within capsule 22. Vial 36 contains a powdered or liquid drug and as is conventional, includes a neck 38 which extends to a rubber-stoppered end 40 with the rubber, pierceable stopper being retained by a metal band 42.

Cap 28 is generally circular and includes three concentric pleats 44 surrounding a planar central portion 46. The circumferential portion 48 of cap 28 is sealed to capsule rim 26 by sonic welding or by use of a hot die. Cap 28 overlies bottom 50 of vial 36 and is spaced a short distance therefrom, so that when planar portion 46 of cap 28 is manually pressed, it will force vial 36 to move downwardly as will be explained in more detail below.

Capsule 22 includes an extending outer tube 52 which surrounds a plastic hub 57. Hub 57 is overmolded around a one-piece stainless steel needle 54 having a spike tip 55 extending into capsule 22 centrally thereof. The other end 56 of hollow needle 54 extends into chamber 18 near the top of the chamber. The lower portion of needle 54 is surrounded by a tubular portion 53 of a plastic frangible member 58. Tubular portion 53 of the frangible member 58 is secured to needle 54 by either an interference fit between the needle and the tubular portion 53 or by using adhesive or by using adhesive with an interference fit.

Frangible member 58 comprises the tubular portion 53, a closed fracturable section 60 and ribs 63, similar to the frangible member disclosed in U.S. Pat. No.

4,340,049. When broken at section 60, the tubular portion 53 will be open at its bottom.

The fracturable member 58 is surrounded by a sleeve 52*a* which defines two side ports 61 disposed relatively high up in the chamber 18. The sleeve 52*a* is connected to container 12 by means of heat seal 14 which secures the outer sheets forming container 12 to sleeve 52*a* when heat seal 14 is applied.

The use of side ports 61 disposed relatively high up in chamber 18 towards seal 14 increases the size of the flow path of fluid, either gas or liquid, going through needle 54 into chamber 18, so that liquid or air passing through the end 56 of needle 54 can exit end 65 of tube 52*a* or can exit from ports 61. Secondly, ports 61 allow for the easy passage of air in chamber 18 back into vial 36. By providing ports 61 relatively high up in the chamber, less air may be maintained in the chamber during manufacture. In other words, container 12 may be manufactured with a higher liquid level. Thus side ports 61 in tube 52*a* allow air to be passed back from container 12 into vial 36 in order to pressurize any liquid in vial 36 for returning the liquid back into the chamber 18.

Figure 3:
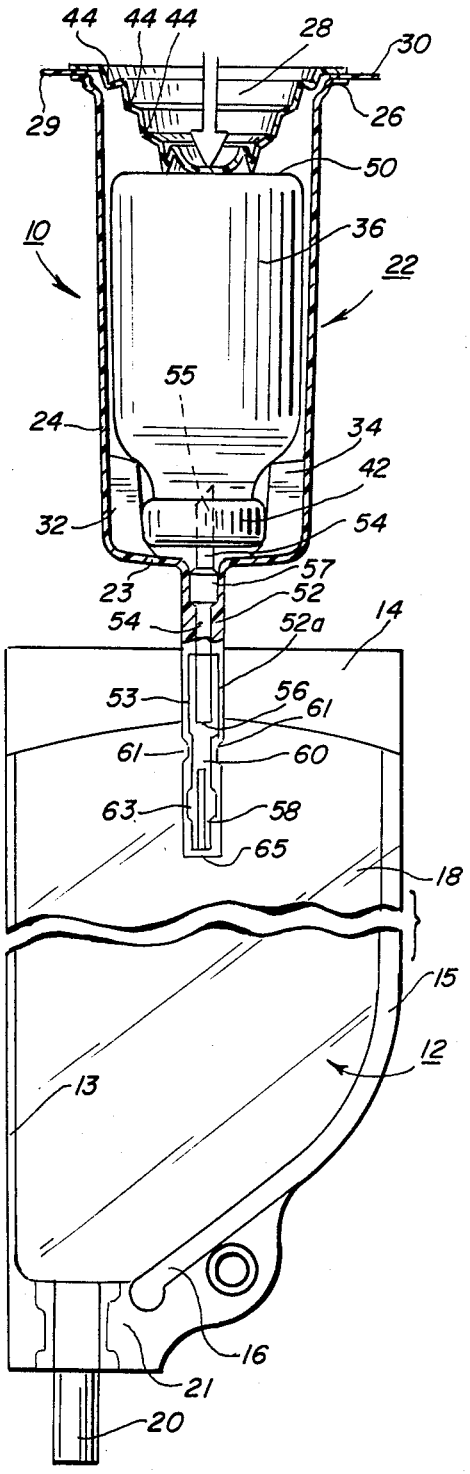
FIG. 3 is a cross-sectional elevation, similar to FIG. 2, but showing the drug vial being moved.

Now referring to FIG. 3, the operation of mixing the drug within vial 36 with the diluent within chamber 18 is as follows. Manual thumb pressure is exerted against planar central member 46 of cap 28 to deform the cap downwardly as illustrated in FIG. 3. This will push vial 36 downwardly as illustrated, and legs 32–35 will give resiliently to enable this downward movement so that spike 55 will pierce the rubber stopper at the end 40 of vial 36. The operator will then manually bend the frangible member 58 to break it around fracturable section 60 and a path will then be opened whereby hollow needle 54 will communicate with the interior of chamber 18 and with the interior of vial 36. Flexible container 12 can then be squeezed appropriately to drive the diluent into vial 36 where it will be mixed with the drug that is within vial 36.

Figure 4:
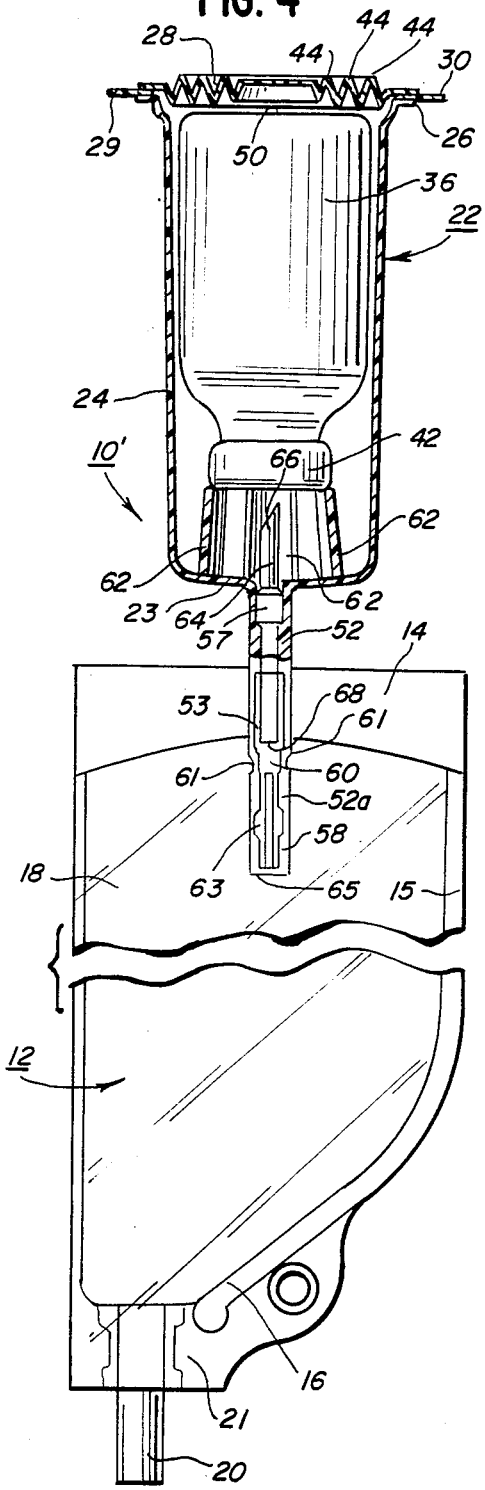
FIG. 4 is a cross-sectional elevation, similar to FIG. 2, but showing a modified embodiment of the present invention.

FIG. 4 shows a closed drug delivery system 10' that is similar in most respects to the system of FIGS. 1–3, except that in the FIG. 4 embodiment, four legs 62 (only three of the legs are shown) extend upwardly from the bottom 23 of capsule 22, to support vial 36. In addition, instead of using a hollow stainless steel needle as in the FIGS. 1–3 embodiment, a hollow, rigid plastic spike 64 is utilized. One end 66 of spike 64 communicates with the interior of capsule 22 while the other end 68 of spike 64 communicates with the interior of chamber 18 once the frangible member 58 is broken.

In the manufacture of the system illustrated in FIGS. 1–3 and the FIG. 4 system, the flexible container 12 with the diluent and the capsule 22 coupled to the flexible container 12, but without cap 28 and vial 36, are steam sterilized. The steam sterilized unit, cap 28 and vial 36 are placed in a room that is then sterilized with gas. Once this gas sterilization is accomplished, vial 36 is inserted into the capsule and the cap 28 is hermetically bonded to lip 26 by sonic welding or by the use of a hot die. The operation with the vial and bonding of the cap can be accomplished using glove portholes or by a person in a "clean suit."

It can be seen that a sterile, closed drug delivery system has been provided which does not require a permanently molded junction, and which allows a safe and easy reconstitution of a drug just prior to use.

Although illustrative embodiments of the invention have been shown and described, it is to be understood that various modifications and substitutions may be made by those skilled in the art without departing from the novel spirit and scope of the present invention.

What is claimed is:

1. A closed drug delivery system which comprises:

a flexible container having a liquid diluent therein, said flexible container having a delivery outlet;

a capsule including a relatively rigid wall coupled to said flexible container, said capsule having means for supporting a drug vial and flexible means for enabling movement of the drug vial relative to the supporting means;

a drug vial having a drug therein adapted to be mixed with said diluent, said drug vial being supported by said supporting means and being adapted for engagement by said flexible means;

means coupling said capsule to the interior of said flexible container, said coupling means including means for communicating with the interior of the drug vial, said communicating means being out of communication with the interior of the drug vial when the vial is in a first position supported by said supporting means, said communicating means being in communication with the interior of the drug vial when the vial has been moved relative to said supporting means and the vial is in another position within said capsule.

2. A system as described in claim 1, said flexible container comprising a sealed vinyl container and said delivery outlet is at a lowest location of the container.

3. A system as described in claim 1, said capsule having a relatively rigid bottom and side walls, and said flexible means comprising a flexible member that is sealed at the top of the side walls, said flexible member being substantially deformable to enable manual downward movement thereof.

4. A system as described in claim 3, said flexible member including a plurality of pleats surrounding a planar central portion, with the flexible member being sealed to the side walls adjacent the periphery of the flexible member.

5. A system as described in claim 3, said flexible member having a generally circular outline and said capsule carrying means for enabling hanging of the capsule.

6. A system as described in claim 1, said capsule having side walls formed in a generally circular configuration, and said flexible means comprising a generally circular flexible member sealed at the top of the side walls and being substantially deformable to enable manual downward movement thereof.

7. A system as described in claim 6, said flexible member including a plurality of pleats surrounding a planar central portion, with the flexible member being sealed to the side walls adjacent the periphery of the flexible member.

8. A system as described in claim 1, said drug vial comprising a standard glass drug vial bottle having a pierceable stopper retained by a metal band, said communicating means comprising a spike for piercing said stopper when the vial is moved onto the spike.

9. A system as described in claim 1, said drug vial having a pierceable stopper, said communicating means comprising a spike for piercing said stopper when the vial is moved onto the spike.

10. A system as described in claim 1, said capsule having a bottom and side walls with said supporting means comprising a plurality of legs extending inwardly from the capsule.

11. A system as described in claim 10, said legs extending upwardly from the bottom of the capsule.

12. A system as described in claim 10, said legs extending radially inwardly from the side walls of the capsule.

13. A system as described in claim 1, said coupling means including a frangible member preventing fluid flow unless the frangible member is broken.

14. A system as described in claim 1, said capsule comprising a relatively rigid plastic housing and said flexible means comprising a plastic bellows cap sealingly covering the plastic housing, the plastic bellows cap being substantially deformable to enable manual downward movement thereof.

15. A system as described in claim 1, said flexible container, said capsule, and said coupling means having sterile interiors whereby the drug delivery system is sterile.

16. A closed drug delivery system which comprises:

a flexible container having a liquid diluent therein, said flexible container having a delivery outlet;

said flexible container comprising a sealed vinyl container and said delivery outlet being at a lowest location of the container;

a capsule coupled to said flexible container, said capsule having means for supporting a drug vial and flexible means for enabling movement of the drug vial relative to the supporting means;

said capsule having a relatively rigid bottom and side walls, and said flexible means comprising a flexible member that is sealed at the top of the side walls, said flexible member being substantially deformable to enable manual downward movement thereof;

said flexible member including a plurality of pleats surrounding a planar central portion, with the flexible member being sealed to the side walls adjacent the periphery of the flexible member;

said flexible member having a generally circular outline and said capsule carrying means for enabling hanging of the capsule;

a drug vial having a drug therein adapted to be mixed with said diluent, said drug vial being supported by said supporting means and being adapted for engagement by said flexible member;

means coupling said capsule to the interior of said flexible container, said coupling means including means for communicating with the interior of the drug vial, said communicating means being out of communication with the interior of the vial when the vial is in a first position supported by said supporting means, said communicating means being in communication with the interior of the vial when the vial has been moved relative to said supporting means and the vial is in another position within said capsule;

said drug vial having a pierceable stopper, said communicating means comprising a spike for piercing said stopper when the vial is moved onto the spike;

said supporting means comprising a plurality of legs extending inwardly from the capsule; and said coupling means including a frangible member preventing fluid flow unless the frangible member is broken.

17. A drug delivery system which comprises:

a flexible container having a liquid diluent therein;

a capsule including a relatively rigid wall coupled to said flexible container, said capsule having means for supporting a drug vial and flexible means for enabling movement of the drug vial relative to the supporting means;

means coupling said capsule to the interior of said flexible container, said coupling means including means for communicating with the interior of the drug vial, said communicating means being out of communication with the interior of the vial when the vial is in a first position supported by said supporting means, said communicating means being in communication with the interior of the vial when the vial has been moved relative to said supporting means and the vial is in another position within said capsule.

18. A system as described in claim 17, said flexible container comprising a sealed vinyl container having a delivery outlet at a lowest location of the container.

19. A system as described in claim 17, said capsule having a relatively rigid bottom and side walls, and said flexible means comprising a flexible member that is sealed at the top of the side walls, said flexible means being substantially deformable to enable manual downward movement thereof.

20. A system as described in claim 19, said flexible member including a plurality of pleats surrounding a planar central portion, with the flexible member being sealed to the side walls adjacent the periphery of the flexible member.

21. A system as described in claim 20, said flexible member having a generally circular outline and said capsule carrying means for enabling hanging of the capsule.

22. A system as described in claim 17, said capsule having side walls formed in a generally circular configuration, and said flexible means comprising a generally circular flexible member sealed at the top of the side walls and being substantially deformable to enable manual downward movement thereof.

23. A system as described in claim 17, including a drug vial having a drug therein adapted to be mixed with said diluent, said drug vial being supported by said supporting means and being adapted for engagement by said flexible means, said drug vial comprising a standard glass drug vial bottle having a pierceable stopper retained by a metal band, said communicating means comprising a spike for piercing said stopper when the vial is moved onto the spike.

24. A system as described in claim 17, including a drug vial having a drug therein adapted to be mixed with said diluent, said drug vial being supported by said supporting means and being adapted for engagement by said flexible means, said drug vial having a pierceable stopper, said communicating means comprising a spike for piercing said stopper when the vial is moved onto the spike.

25. A system as described in claim 17, said capsule having a bottom and side walls with said supporting means comprising a plurality of legs extending inwardly from the capsule.

26. A system as described in claim 17, said coupling means including a frangible member preventing fluid flow unless the frangible member is broken.

27. A system as described in claim 17, said capsule comprising a relatively rigid plastic housing and said flexible means comprising a plastic bellows cap sealingly covering the plastic housing, the plastic bellows cap being substantially deformable to enable manual downward movement thereof.

28. A drug delivery system which comprises:
a flexible container having a liquid diluent therein;
a capsule including a relatively rigid wall, coupled to said flexible container, said capsule having means for supporting a drug vial and flexible means for enabling movement of the drug vial relative to the supporting means, said flexible means including a flexible member having a plurality of pleats surrounding a planar central portion, with the flexible member being sealed to said wall adjacent the periphery of the flexible member, said flexible member being substantially deformable to enable manual downward movement thereof;
means coupling said capsule to the interior of said flexible container, said coupling means including means for communicating with the interior of the drug vial, said communicating means being out of communication with the interior of the vial when the vial is in a first position supported by said supporting means, said communicating means being in communication with the interior of the vial when the vial has been moved relative to said supporting means and the vial is in another position within said capsule.

29. A drug delivery system which comprises:
a flexible container having a liquid diluent therein;
a capsule having side walls formed in a generally circular configuration, coupled to said flexible container, said capsule having means for supporting a drug vial and flexible means for enabling movement of the drug vial relative to the supporting means, said flexible means including a generally circular flexible member having a plurality of pleats surrounding a planar central portion, with the flexible member being sealed to the side walls adjacent the periphery of the flexible member;
means coupling said capsule to the interior of said flexible container, said coupling means including means for communicating with the interior of the drug vial, said communicating means being out of communication with the interior of the vial when the vial is in a first position supported by said supporting means, said communicating means being in communication with the interior of the vial when the vial has been moved relative to said supporting means and the vial is in another position within said capsule.

30. A drug delivery system which comprises:
a flexible container having a liquid diluent therein;
a capsule coupled to said flexible container, said capsule having means for supporting a drug vial and flexible means for enabling movement of the drug vial relative to the supporting means, said supporting means including a plurality of legs extending inwardly from the capsule;
means coupling said capsule to the interior of said flexible container, said coupling means including means for communicating with the interior of the drug vial, said communicating means being out of communication with the interior of the vial when the vial is in a first position supported by said supporting means, said communicating means being in communication with the interior of the vial when the vial has been moved relative to said supporting means and the vial is in another position within said capsule.

31. A system as described in claim 30, said capsule further comprising a bottom and side walls.

32. A system as described in claim 31, said legs extending upwardly from the bottom of the capsule.

33. A system as described in claim 31, said legs extending radially inwardly from the side walls of the capsule.

34. A drug delivery system which comprises:
a flexible container having a liquid diluent therein;
a capsule including a relatively rigid housing, coupled to said flexible container, said capsule having means for supporting a drug vial and flexible means for enabling movement of the drug vial relative to the supporting means, said flexible means including a plastic bellows cap sealingly covering the housing, the plastic bellows cap being substantially deformable to enable manual downward movement thereof;
means coupling said capsule to the interior of said flexible container, said coupling means including means for communicating with the interior of the drug vial, said communicating means being out of communication with the interior of the vial when the vial is in a first position supported by said supporting means, said communicating means being in communication with the interior of the vial when the vial has been moved relative to said supporting means and the vial is in another position within said capsule.

35. A system as described in claim 28, further comprising a drug vial having a drug therein adapted to be mixed with said diluent, said drug vial being supported by said supporting means and being adapted for engagement by said flexible means.

36. A system as described in claim 29, further comprising a drug vial having a drug therein adapted to be mixed with said diluent, said drug vial being supported by said supporting means and being adapted for engagement by said flexible means.

37. A system as described in claim 30, further comprising a drug vial having a drug therein adapted to be mixed with said diluent, said drug vial being supported by said supporting means and being adapted for engagement by said flexible means.

38. A system as described in claim 34, further comprising a drug vial having a drug therein adapted to be mixed with said diluent, said drug vial being supported by said supporting means and being adapted for engagement by said flexible means.

* * * * *